United States Patent [19]

Green

[11] 4,362,210

[45] Dec. 7, 1982

[54] FRICTION HOLD WEAR BUSHING

[76] Inventor: James R. Green, 3823 Ridgelake, Apt. 223, New Orleans, La. 70124

[21] Appl. No.: 212,855

[22] Filed: Dec. 4, 1980

[51] Int. Cl.[3] ..... E21B 33/03

[52] U.S. Cl. ..... 166/85; 166/82; 285/39; 285/338

[58] Field of Search ..... 285/39, 338; 166/82, 166/85, 75

[56] References Cited

U.S. PATENT DOCUMENTS

| | | | |
|---|---|---|---|
| 2,926,701 | 3/1960 | Campbell | 285/39 |
| 2,959,193 | 11/1960 | Guldenzoph et al. | 285/39 |
| 3,137,348 | 6/1964 | Ahlshore et al. | 285/DIG. 21 |
| 3,247,914 | 4/1966 | Slack | 166/85 |
| 3,334,923 | 8/1967 | Patch | 285/18 |
| 3,797,864 | 3/1974 | Hynes | 285/338 |

*Primary Examiner*—William F. Pate, III

*Attorney, Agent, or Firm*—Guy E. Matthews

[57] ABSTRACT

A wear bushing for use in the drilling of oil and gas wells is disclosed for the protection of the casing being drilled within against damage by drill string members. Novel means are disclosed for the positioning and mounting of the wear bushing with the casing such that it is held in position against forces produced during drilling operations.

5 Claims, 3 Drawing Figures

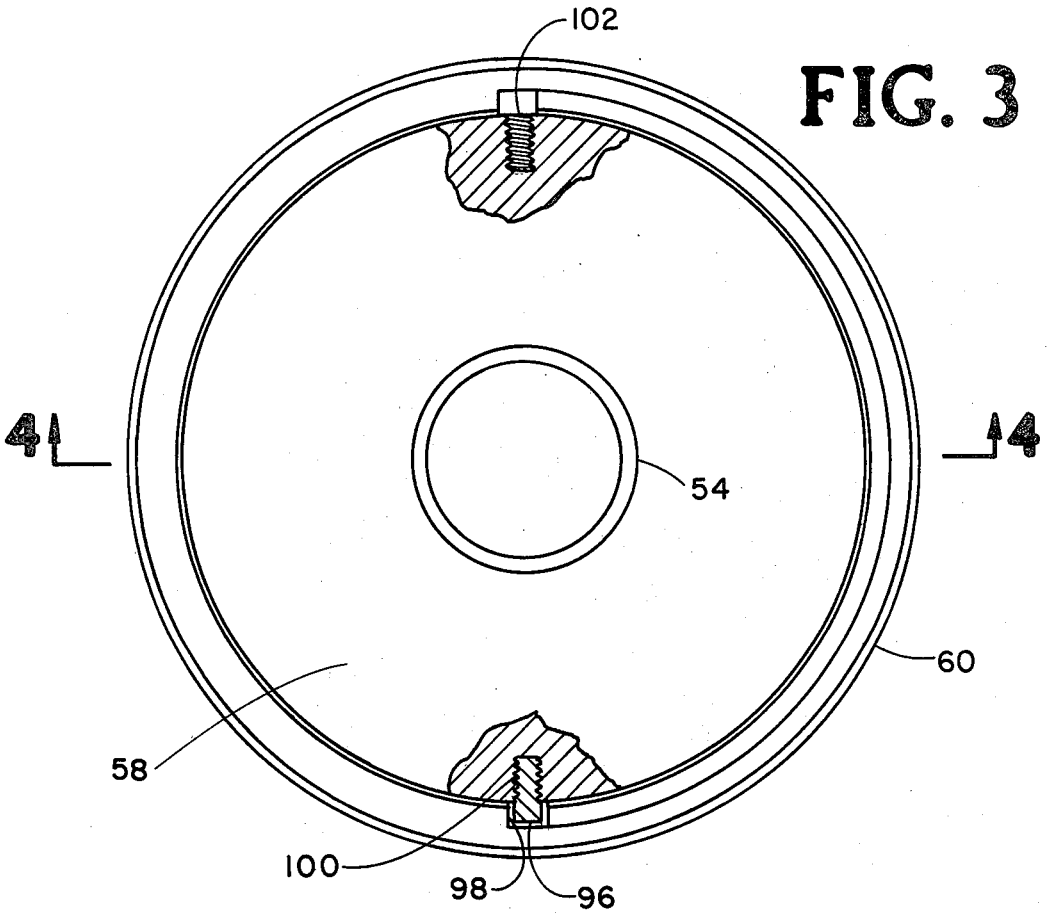
FIG. 3
FIG. 4
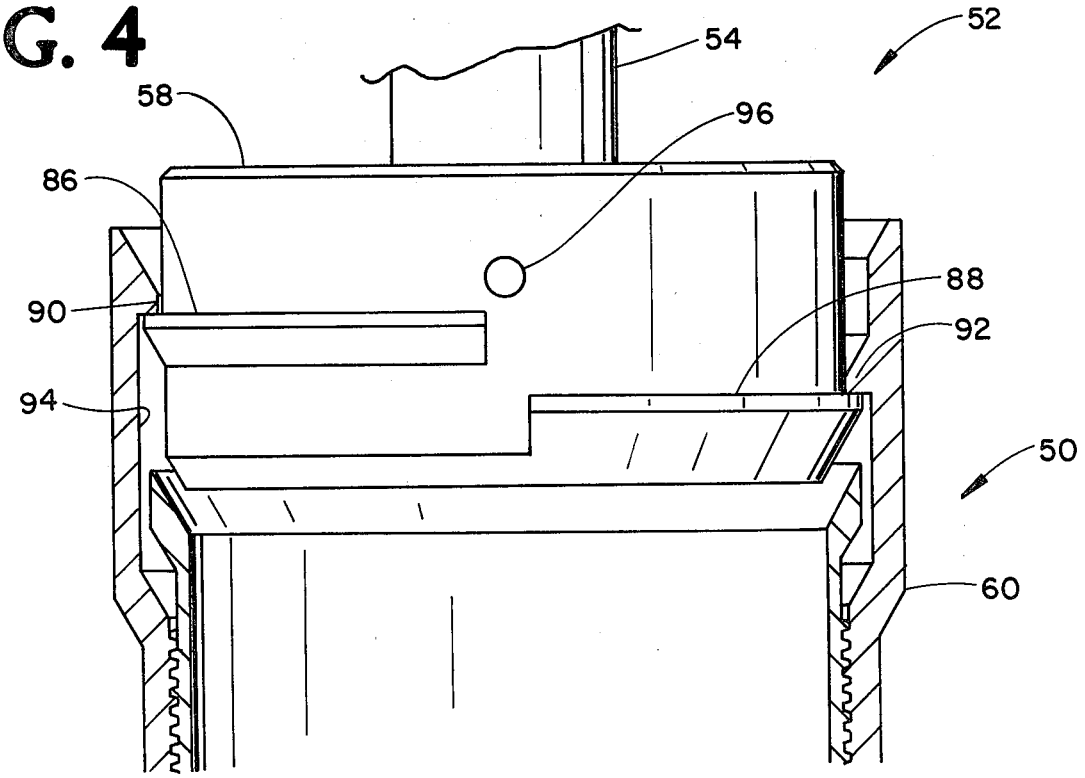

FRICTION HOLD WEAR BUSHING

FIELD OF THE INVENTION

The present invention is generally related to tools for use in the drilling of deep oil and gas wells. More particularly, the present invention is related to devices used within the bore of a wellhead assembly during the drilling of a well, for protection of the internal surfaces of the wellhead assembly bore, against damage from drill string members passing therethrough.

BACKGROUND OF THE INVENTION

The rotary drilling of a deep oil or gas well requires that many joints of drill pipe having enlarged screwed end connections, be raised, lowered and rotated for months so as to drive the drill bit against the bottom of the hole. During such a process, the wellhead assembly bore near the top of the casing string being drilled through, may be severely damaged by members of the drill string such as drill pipe, tool joints, bits and drill collars as the drill string is lowered or rotated within the wellhead bore. Maximum damage to the wellhead assembly bore usually occurs in a zone immediately below the level that the wellhead assembly bore reduces to the bore of the casing string being drilled through, the bore of the casing head, the blow out preventers, the drilling spool and such that may be a part of the wellhead assembly, being greater. Such damage results in loss of metal from the casing wall to thereby weaken the casing and vastly increase the danger of blowouts and even loss of the well.

So as to prevent or at least reduce such damage to the wellhead assembly bore, various devices have been used above the level that the wellhead assembly bore substantially equals the casing bore, to guide the drill string members from the larger upper bores of the wellhead assembly and into the casing bore below, such as: retractable guide ram members mounted in a drilling spool; a ring member having a bore therethrough substantially equal to the casing bore, having an outer diameter sufficient to pass through the wellhead assembly above the level that the wellhead assembly bore substantially equals the casing bore, the ring member having guide surfaces from the outer diameter to the bore therethrough; a removeable ring member as described but having an outer diameter greater than the upper wellhead assembly bore and mounted above the wellhead assembly. Devices as described above have served well under certain conditions, however each possess undesirable characteristics that prevent their successful use, such as: when the casing bore is substantially less than the bore of the upper portion of the wellhead assembly, projection of guide rams may be excessive and thereby vulnerable to damage from drill string members; when the wellhead assembly is forced from a normal vertical mounting to a leaning position by drilling forces and by vibration, the ring member mounted above the wellhead assembly can no longer serve as a guide into the casing bore, the drill string hanging vertically; the ring member that is lowered into the wellhead assembly being subject to vibration and impact from the drill string such that the ring member is displaced from its normal guide position so as to prevent proper guiding of the drill string members. Therefore, features of the present invention are to: provide protection for the bore of a wellhead assembly against damage caused by drill string members; provide for protection for the upper zone of a casing string against damage caused by drill string members; provide means for removably mounting an apparatus for protecting the bore of a wellhead assembly against damage caused by drill string members such that the apparatus will be held securely in position during drilling operations; provide for extended protection of the casing bore by means of a portion of an apparatus positioned within an upper section of the casing bore; provide for means for automatically centering the apparatus with respect to the casing bore.

SUMMARY OF THE INVENTION

The present invention comprises an apparatus for guiding drill string members toward the center of the well bore during drilling operations so as to prevent damage to the bores of the wellhead assembly members defining the wellhead assembly bore, the invention also comprising means for removably mounting the apparatus.

A mandrel having a bore therethrough sufficient for passage of the drill string members and provided with packing means positioned around a lower section of the mandrel together with means to reversably compress the packing; is dimensioned such that the lower section of the mandrel may be positioned within an upper section of the casing, such that the packing may be compressed to thereby deform the packing laterally to contact the mandrel and the casing bore under pressure sufficient to firmly mount the mandrel with the casing against forces on the mandrel encountered during drilling operations.

External threads on the mandrel cooperate with internal threads of a nut member for the purpose of reversably compressing the packing as the nut is rotated with respect to the mandrel.

A wrench member having semicircular external flanges for cooperating with semicircular internal flanges formed within an upper bore of the nut member is provided so as to lift and mount the apparatus.

The mandrel and nut may be made of high hardness materials so as to increase the wearlife thereof.

BRIEF DESCRIPTION OF THE DRAWINGS

FIG. 3 is a plan view of the wear bushing and the wrench taken from FIG. 1.

DESCRIPTION OF THE PREFERRED EMBODIMENTS

Figure 1:
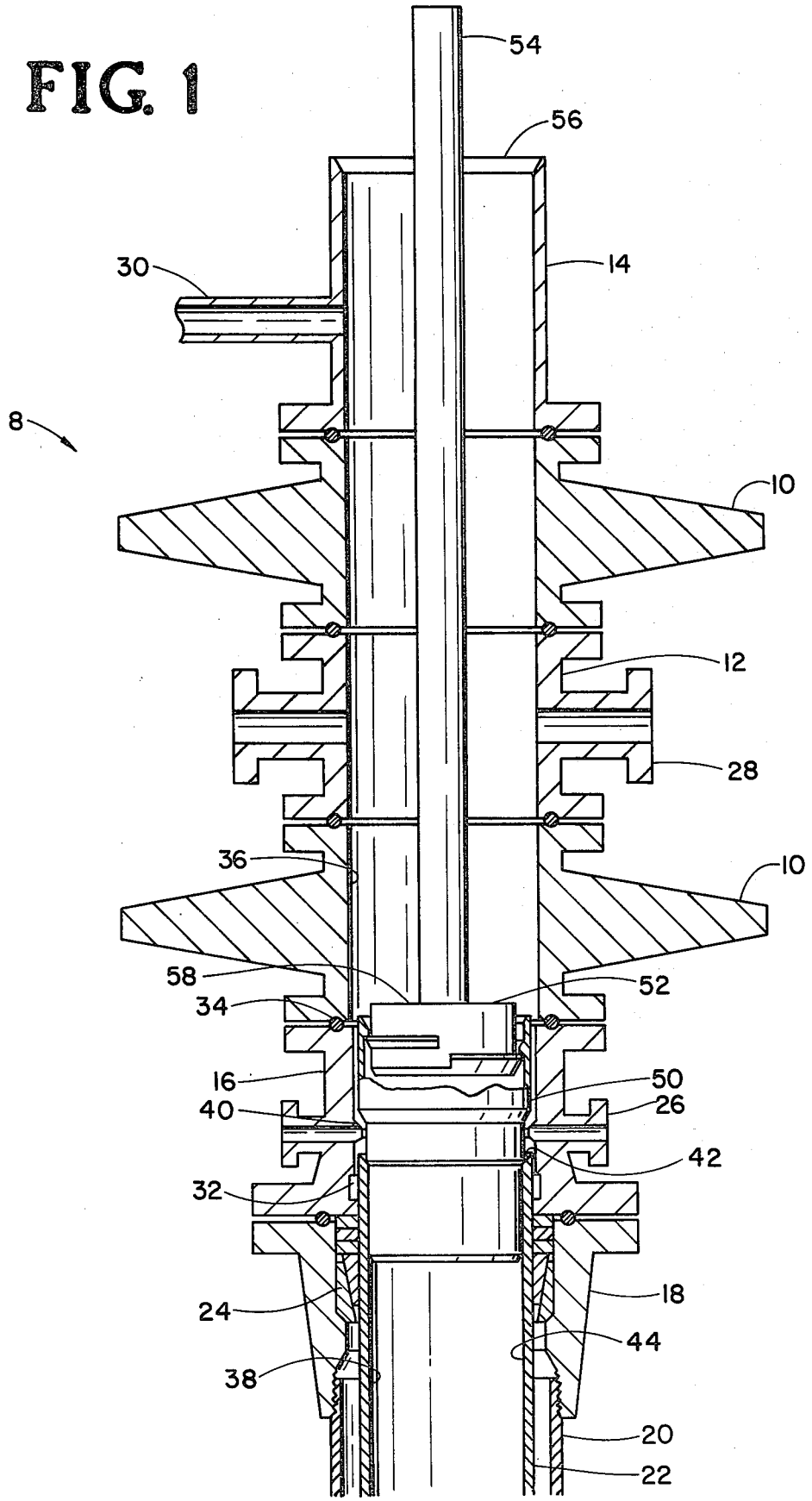
FIG. 1 illustrates a vertical section of a wellhead drilling assembly having the apparatus, a "Friction Hold Wear Bushing" mounted with the casing and showing the wrench in place as for mounting of the apparatus.

Conventional wellhead drilling assembly 8 as shown in FIG. 1 may comprise: blowout preventers 10, mud cross 12, mud riser 14, casing head spool 16 and casing head 18 or other variations as may suit a particular situation. Casing head 18 is mounted on the first set string of casing 20, casing head 18 then being drilled through and below the lower end of casing 20 so as to provide a deeper hole for the setting of casing string 22 which may be suspended by casing hanger 24 which in turn is supported by casing head 18. Outlets as at 26, 28 and 30 of assembly 8 are connected with the drilling mud system as is well known in the art.

Casing 22 is sealed around its periphery as at 32 and drilling assembly flanges are sealed in a conventional manner as by ring 34 so as to prevent escape of fluid from the bore 36 of assembly 8, in the event of a well kick necessatating closure of the blow out preventers to prevent drilling mud from being blown out of the well. Bore 36 through members 10, 12 and 14 is larger than bore 38 of casing 22 so as to allow for a shoulder as at 40 on which to support a next hanger not shown, but similar to hanger 24, for the support of a next string of casing string to be suspended within and below casing string 22. Upper end 42 of casing string 22 and shoulder 40 are subject to damage by wear and impact from drill string members being lowered and rotated within casing string 22 as is also upper zone 44 of casing bore 38. Such wear and impact damage may cause severe metal removal such that shoulder 40 is destroyed to thereby prevent proper suspension and sealing of the hanger for the next string of casing. Zone 44 is also subject to metal removal which on occasion has weakened the ability of casing 22 to hold pressure so as to cause rupture and release of pressure from the casing and thereby cause a well blowout, environmental pollution, extreme waste and great danger to personnel. It is therefore desirable to prevent damage to such areas during the drilling of deep wells especially because high pressures are anticipated within the drilling assembly. For that purpose, the wear bushing of the present invention shown generally at 50 is shown mounted with casing 22 and within bores 36 and 38, so as to prevent damage to shoulder 40, end 42 of casing 22 and upper zone 44 of casing bore 38, installation wrench shown generally at 52 being a part of the present invention.

Handle 54 of wrench 52 projects above the top 56 of drilling assembly 8 so as to allow manipulation of wrench 52 as required to install wear bushing 50. Head 58 of wrench 52 is provided with suitable means for releasable connection with wear bushing 50 as described below.

Figure 2:
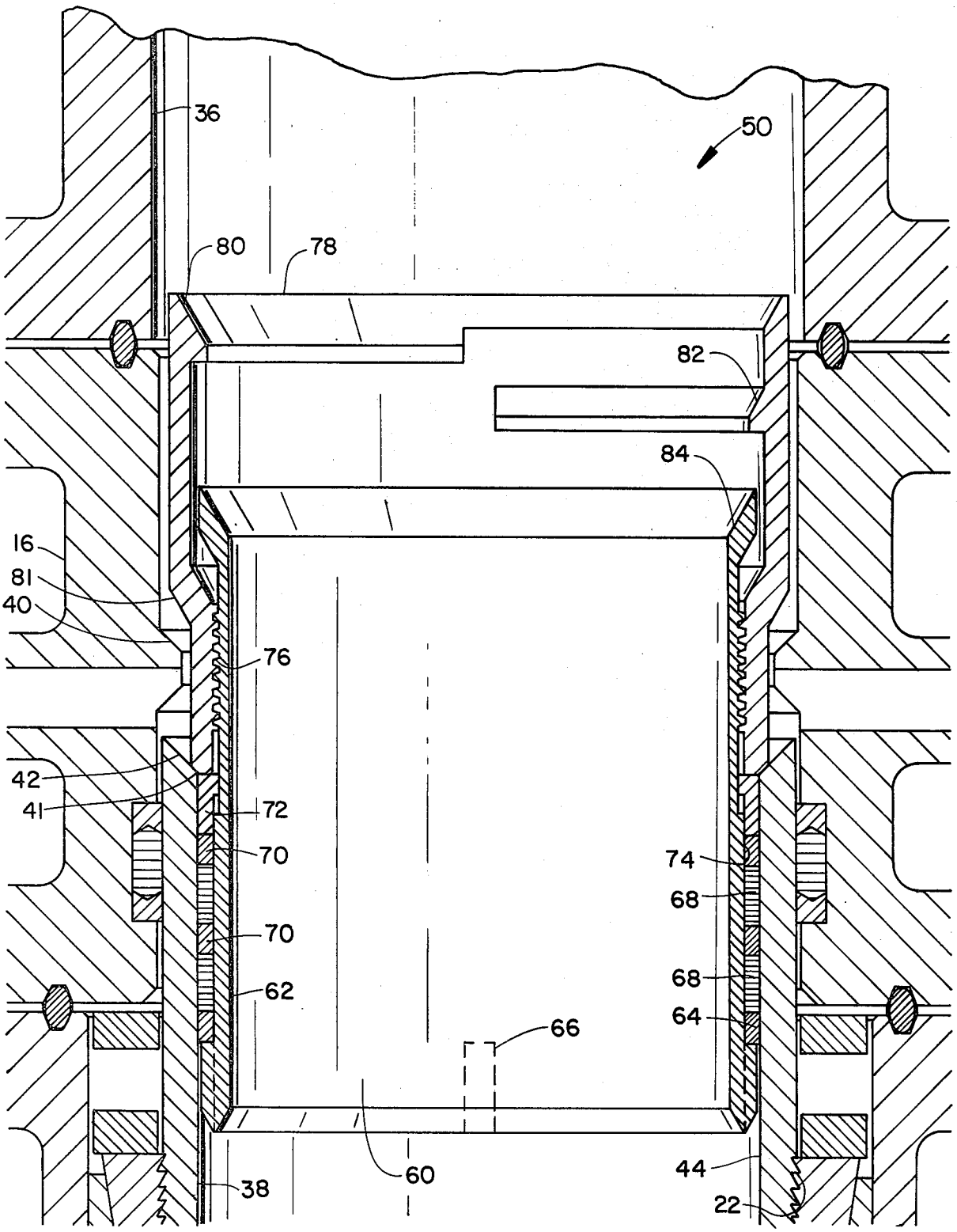
FIG. 2 is an enlarged fragmentary section taken from FIG. 1, the wrench being removed therefrom.

FIG. 2 illustrates wear bushing 50 in greater detail, the bushing comprising mandrel 60 having lower section 62 for mounting within zone 44 of casing bore 38 of casing string 22. Mandrel 60 is formed with means for positioning packing retaining ring 64 as by lugs 66 so as to prevent downward movement of ring 64 with respect to mandrel 60. Packing as at 68 is positioned by ring 64 and by rings 70 such that when ring 72 is forced downwardly toward ring 64, packing 68 is compressed and distorted laterally so as to be in high pressure contact with bore 38 and surface 74 of mandrel 60 to thereby securely mount mandrel 60 with casing 22 against forces transmitted from drill string members passing therethrough. Cooperating screw threads as at 76 are provided such that rotations of nut 78 advances nut 78 on mandrel 60 so as to act through rings 70 and 72 and thereby causes compression of packing 70. Guide surfaces 80 and 82 of nut 78 and guide surface 84 of mandrel 60 serve to guide drill string members inwardly from bore 36 of drilling assembly 8 so as to be restrained by bore 62 of the mandrel and thereby be prevented from damaging or even contacting shoulder 42 of casing head spool 16, upper end 42 or upper zone 44 of casing string 22.

Now referring to FIGS. 3 and 4, head 58 of wrench 52 is formed with upper semicircular flange 86 and with lower semicircular flange 88 dimetrically opposed to flange 86, for the purpose of engaging upper flange 90 and 92 respectively, formed within bore 94 of nut 78 flanges 90 and 92 being diametrically opposed to each other such that wear bushing be lifted into or out of bore 36 and drilling assembly 8. Although flanges 86, 88, 90 and 92 are substantially semicircular, clearance between the flange ends as at 85, is made sufficient to allow the wrench flanges to pass the nut flanges when the nut is lifted. So as to allow for the wrench being releasably connected with the nut, the wrench may be rotated one half revolution from the position of FIG. 4 such that semicircular flange 86 is no longer beneath semicircular flange 90 and semicircular flange 88 is no longer beneath semicircular flange 92, such that the wrench may be lifted so as to position flange 88 in the position of flange 86 as shown in FIG. 4, the wrench again being rotated one half revolution to remove flange 88 from under flange 90, thereby allowing the wrench to be lifted out of connection with nut 78 and out of bore 36.

For the purpose of limiting rotation of the wrench with respect to the nut such that the nut can be driven to tighten the packing so as to mount the wear bushing, stop means 96 may be provided to act against end 98 of flange 90, being positioned in FIG. 3 so as to drive the nut clockwise so as to tighten the packing after which the wrench is removed as described above. At such time that the wear bushing is to be removed from the casing and from the drilling assembly, pin 98 may be removed from attachment means such as threads 100 and reattached on the opposite side of wrench head 58 as at 102, thereby providing for drive of the nut in counterclockwise rotation so as to loosen the packing to thereby allow for removal of the wear bushing.

OPERATION OF THE INVENTION

After casing 22 has been set in the well and the drilling assembly has been installed as illustrated in FIG. 1, and before drilling operations commence, all in a conventional manner, wear bushing 50 may be installed as follows: nut 78 is adjusted so as to cause the nut to maintain in contact but not to compress, members 62, 70 and 72; pin 96 is attached to wrench head 58 by means of threads 100 so as to allow for clockwise rotation to thereby compress the packing; flange 88 of the wrench is inserted into bore 94 of the nut in a position opposite to that of flange 90 such that the lower surface of flange 88 contacts the upper surface of flange 92; the wrench is then rotated one half turn and positioned further into bore 94 until the lower surface of flange 86 contacts the upper surface of flange 92; the wrench is then rotated clockwise until pin 96 contacts end 98 of flange 90; the wear bushing may then be lifted by means of the wrench and lowered into bore 36 such that the lower section of the wear bushing enters bore 38 of casing 22; depending on the particular well head configuration and the operators preference; the lower most position of the wear bushing may be determined by surface 41 of the nut contacting end 42 of the casing or by surface 81 of the nut contacting surface 40 of the casing head spool, the contacting surfaces also transmitting vertical loads from the wear bushing to the wellhead; after the wear bushing reaches its lower most position, the packing fit providing a drag against bore 38, the wrench is rotated clockwise which in turn rotates the nut and comprises the packing to deform it under high pressure against the mandrel and the casing bore so as to firmly mount the wear bushing with casing 22 against forces caused by the drill string. The wrench is then removed as described above. Thereafter, as a drill string member such as a bit, a drill collar or a tool joint is lowered or rotated within bores 36 and 38, they will be guided to the center by surfaces 80, 82 and 84 and will be maintained out of contact with surfaces 40, 42 and 38 by bore 62 of mandrel 60. After the bore hole is drilled to the desired depth, the drill string is removed from the well and before the next string of casing is lowered into the well, the wear bushing must be removed. Pin 96 is then reattached at attachment position 102 so as to provide for a counter clockwise drive of the nut. The wrench head is then lowered into bore 36 so as to be guided by guide surface 80 of nut 78 and thereby enter and rotate within bore 94 of the nut in reverse to that described above to reconnect the wrench with the nut. Upon counter clockwise rotation of the wrench, the packing is decompressed to release its tight engagement with bore 36. The wrench is then raised to remove the wear bushing from the drilling assembly. Although clockwise rotation is specified above to tighten the packing, the use of left hand threads on the nut and mandrel may serve to reverse the respective rotational effect. Other embodiments that fall within the spirit and scope of my invention will become obvious to those skilled in the art upon practice thereof and the embodiment disclosed herein should be taken as illustration only and not in any limiting manner.

What is claimed is:

1. An apparatus to protect the upper section of a string of oil well casing from drill string members passing therethrough, comprising: a tubular mandrel having a lower section for positioning within the upper section of the casing; the mandrel having a bore therethrough sufficient for the passage of drill string members; pliable packing disposed around and retained with the lower section of the mandrel; the packing being dimensioned so as to be positioned within and to be squeezed against the casing bore; means for reversably compressing the packing between the mandrel and the casing bore such that the mandrel is sufficiently mounted with the casing, against forces caused by the drill string members; said means for reversably compressing the packing including external threads formed with an upper portion of the mandrel, and annular ring positioned around the mandrel below the packing, means to retain the ring against downward movement with respect to the mandrel, a nut formed with internal threads for cooperating with the mandrel threads so as to compress the packing between the ring and the nut when the nut is rotated, such that the packing is deformed laterally and forced into contact with the mandrel and the casing bore so as to firmly mount the mandrel with the casing; the nut having an upper bore formed with a plurality of inwardly projecting circumferential flanges, each flange being axially disposed from the others, each of the flanges extending for substantially one half the circumference around the bore, axially adjacent flanges being positioned diametrically opposite from each other; and a wrench member having sufficient length to reach and engage the nut when the nut and mandrel are mounted with the casing, the wrench and nut comprising a releasable connection sufficient to rotate the nut to thereby reversably compress the packing, and to lift the apparatus.

2. The invention of claim 1 further comprising: the wrench having an external surface formed with a plurality of outwardly projecting circumferential flanges, each being axially disposed from the others; each external flange being substantially semicircular; axially adjacent external flanges being positioned diametrically opposite from each other; the external flanges being dimensioned for cooperation with the nut bore and the internal flanges such that the wrench may be positioned within the nut bore with the upper surfaces of the external flanges being in contact with the lower surfaces of the internal flanges so as to lift the apparatus; means to limit rotation of the wrench with respect to the nut.

3. The invention of claim 2 wherein the means to limit rotation of the wrench with respect to the nut comprise: the external surface of the wrench being formed with a stop member positioned so as to engage a side of an internal flange and thereby limit rotation of the wrench with respect to the nut.

4. The invention of claim 3 wherein the stop member may be selectively positioned for clockwise rotation to connect the wrench to the nut.

5. The invention of claim 3 wherein the stop member may be selectively positioned for counter clockwise rotation to connect the wrench to the nut.

* * * * *